US005760353A

United States Patent [19]

Rapp

[11] Patent Number: 5,760,353

[45] Date of Patent: Jun. 2, 1998

[54] SAFETY SWITCH

[75] Inventor: Werner Rapp, Geislingen, Germany

[73] Assignee: Euchner & Co., Leinfelden-Echterdingen, Germany

[21] Appl. No.: 602,756

[22] PCT Filed: Jul. 5, 1994

[86] PCT No.: PCT/EP94/02202

§ 371 Date: Jun. 26, 1996

§ 102(e) Date: Jun. 26, 1996

[87] PCT Pub. No.: WO95/06323

PCT Pub. Date: Mar. 2, 1995

[30] Foreign Application Priority Data

Aug. 23, 1993 [DE] Germany ..... 43 28 297.0

[51] Int. Cl.[6] ..... H01H 27/00

[52] U.S. Cl. ..... 200/17 R; 200/43.04

[58] Field of Search ..... 200/61.62–61.69, 200/17 R, 43.02, 43.04, 43.07, 43.05, 43.06, 43.08, 334, 520, 533, 573, 43.11, 43.13, 43.16, 43.17, 318, 323, 324, 318.1; 335/63, 77, 86, 87, 165, 170, 174

[56] References Cited

U.S. PATENT DOCUMENTS

| | | | |
|---|---|---|---|
| 4,904,829 | 2/1990 | Berthaud et al. | 200/50 R |
| 5,464,954 | 11/1995 | Kimura et al. | 200/61.62 |
| 5,488,207 | 1/1996 | Niwa et al. | 200/43.04 |
| 5,584,378 | 12/1996 | Wecke et al. | 200/43.04 |

FOREIGN PATENT DOCUMENTS

| | | | |
|---|---|---|---|
| 0330229 | 8/1989 | European Pat. Off. | F16P 3/08 |
| 0 553 885 A1 | 4/1993 | European Pat. Off. | H01H 27/00 |
| 3430090C2 | 3/1986 | Germany | H01H 27/00 |
| 37 10079 A1 | 6/1988 | Germany | F16P 3/08 |
| 3810287C2 | 6/1988 | Germany | H01H 27/06 |
| 3943376C1 | 6/1991 | Germany | F16P 3/10 |
| 41 34 083 A1 | 7/1991 | Germany | F16P 3/08 |
| 4303367C1 | 2/1994 | Germany | H01H 27/00 |
| G 9212093 U | 2/1994 | Germany | F16P 3/08 |

OTHER PUBLICATIONS

Prospectus, "Command Sytem", European Standard pr. EN 1088, May 1993.

*Primary Examiner*—Michael L. Gellner
*Assistant Examiner*—Michael A. Friedhofer
*Attorney, Agent, or Firm*—Wigman, Cohen, Leitner & Myers, P.C.

[57] ABSTRACT

A compact safety switch comprises a housing having an axially sliding ram mounted therein. The lower end of the ram is in contact with an actuating rod of a switch, which is aligned with the ram. The upper end of the ram lies against a cam formed in the outer surface of an indexing wheel. A pre-tensioned helical spring surrounds the lower end of the ram for holding the ram in place. The indexing wheel is provided on one end of the cam with a radial notch for locking a key inserted into the keyway and at an opposite end of the cam with a resting notch. The safety switch further includes an interlocking mechanism having a stator located concentric to the ram and an armature integral with the ram. With the key inserted in the keyway, the armature is pushed out of the stator and the upper end of the ram is held in engagement with the resting notch. The key cannot be removed from the keyway at this time and is not released upon shutting of the machine, as the corresponding rotation of the indexing wheel is prevented by the ram. Only when the machine comes to a standstill is the stator energized and the ram lifted from the resting notch. The upper end of the ram proceeds to travel along the cam on its high side, causing the lower end of the cam to be pushed against the switch, thereby forcing the switching circuit in the control circuit of the machine open.

8 Claims, 1 Drawing Sheet

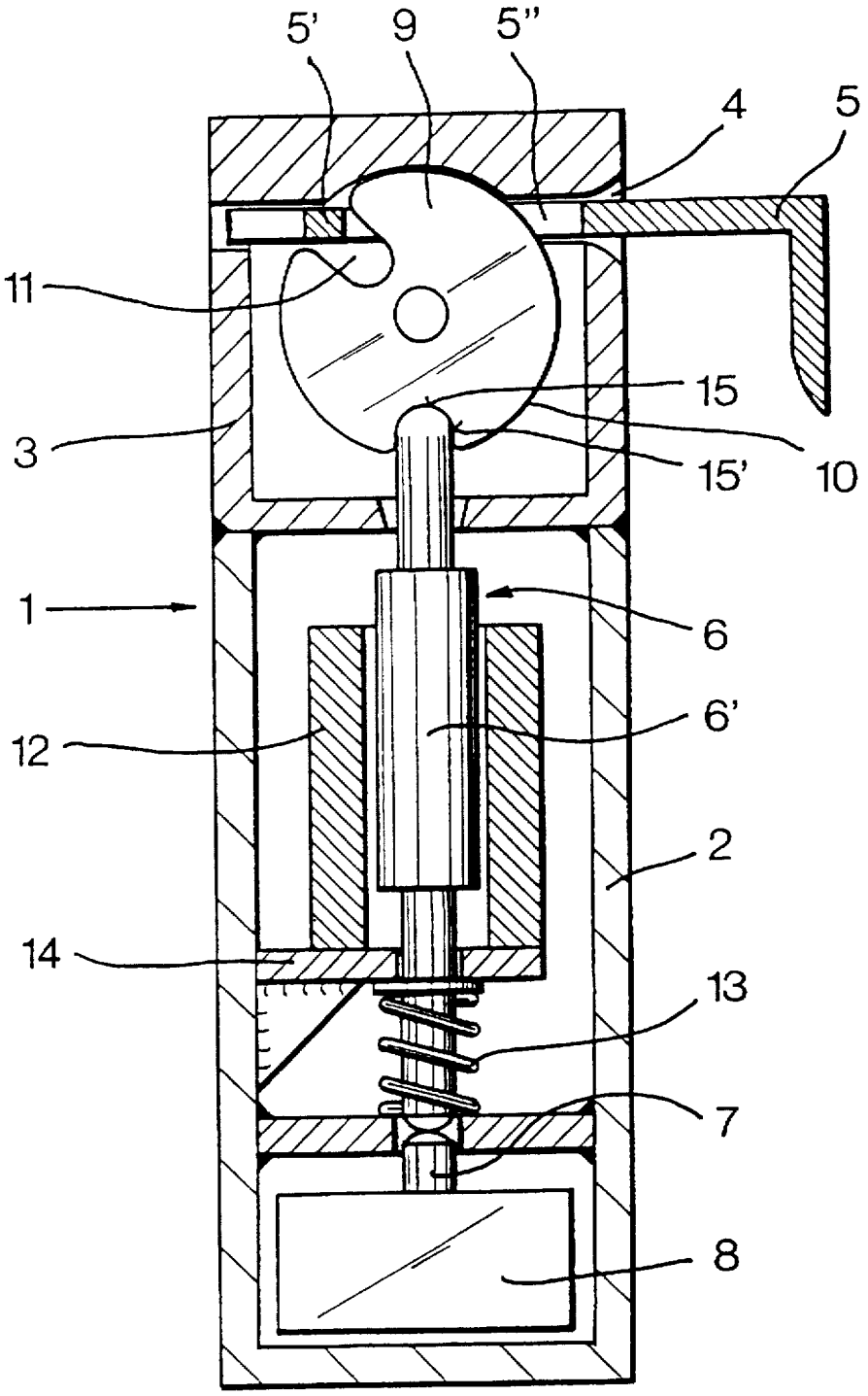
5'
9
5"
4
5
11
15
3
15'
10
1
6
12
6'
2
14
13
7
8

SAFETY SWITCH

TECHNICAL FIELD

The invention pertains to a safety switch, which has an axially sliding ram, an indexing wheel with a cam having a locking flank, a pre-tensioned spring for holding the ram in place, a key for turning the indexing wheel, and an interlocking mechanism including an electromagnet having a stator and an armature.

BACKGROUND ART

Safety switches are used everywhere where it must be ensured that a door, cover or the like, which in the locked state prevents access to the secured area of a machine, can only be opened when the machine is shut off, and where the machine can only be turned on when the door or the like is shut. If, in addition, the key is not to be removed from the keyway of the safety lock exactly when the machine is turned off but rather when the machine comes to a standstill, the safety switch has an additional interlocking device in which the key is held in the keyway during the time span corresponding to the slow-down time. Known safety switches have an electromagnet for this purpose which either holds a latch in the locked position or pulls the latch, held in place with a pre-tensioned spring, out of the locked position. The latch coordinates in its locked position with either the ram or directly with the key.

Since this known solution is cost intensive and uses up space, the objective of creating a safety switch of the above named type whose interlocking mechanism can be realized cost-effectively and with minimal space is the basis of this invention. This objective is met with a safety switch with the features of the present invention.

DISCLOSURE OF INVENTION

Since a section of the ram is construed as an armature, only the stator portion of the electromagnet is required as an additional component compared to safety switches without interlocking mechanisms, which leads to a significant cost reduction. The space requirement is reduced for one reason because the stator surrounds the ram, for another since components are not required which transfer the magnetic force produced by the stator to the ram as a locking force.

The locking flank seated against the ram when the interlocking mechanism is in effect, preventing the indexing wheel from turning, which is a prerequisite for removal of the key from the keyway, can be formed by one flank of a resting notch in the cam, wherein the ram engages in the particular position of the indexing wheel in which the key is fully inserted into the keyway and thus the door or the like to be secured is completely closed.

The interlocking mechanism can effect either a magnetically driven lock or a spring-driven lock. In the first case, an electromagnet forces the ram against, generally, a spring force, onto the cam. In the second case, the ram pressed onto the cam by a pre-tensioned spring. The electromagnet then unlocks the indexing wheel in the energized state.

As long as the force of the stator of the electromagnet on the ram is sufficient to create the prescribed locking force for the key or compensate for the locking force produced by a pre-tensioned spring, no self-locking is needed between the locking flanks and the ram. Generally, it is an advantage to provide a self-lock, since then a considerably smaller magnetic force would be sufficient which leads to cost-effective and space-conserving electromagnets.

In what follows, the invention is detailed with the help of an example of an embodiment represented in the illustration.

BRIEF DESCRIPTION OF DRAWINGS

The single FIGURE shows a schematically represented section of the embodiment example in the axial direction of its ram.

BEST MODE FOR CARRYING OUT THE INVENTION

A safety switch shown in its entirety as 1 has a rectangular shaped housing 2 in this example which can consist of metal or plastic. On one end face of the housing 2, housing 3 of a head piece is attached, which forms the keyway 4 for a key 5 which serves to activate the switch. Housing 3, consisting of either metal or plastic as in housing 2, is constructed such that it can be mounted to housing 2 not only in the position represented in the figure but also turned 90° or 180° from his position using screws, not represented here.

An axially sliding ram 6 is mounted in housing 2. Its lower end is in contact with an actuating rod 7 of a switch 8, which is aligned with the ram 6. This switch contains at least one switching circuit which is closed when the key is completely inserted into the keyway 4 and open when the key 5 is removed from the keyway 4.

The upper end of the ram 6 lies against a cam 10 formed from a section of the outer surface of an indexing wheel 9. The turning axis of the indexing wheel 9 mounted in housing 3 intersects the longitudinal axis of the ram 6 at a right angle. The indexing wheel 9 is provided on one end of the cam 10 with a radial notch 11 cut into it wherein a crossbar 5' of the key 5 comes into contact with one of its flanks when the key 5 is inserted into the keyway 4. A recess 5" extending along the length of the key 5 joins with the crossbar 5' and the indexing wheel 9 engages in it when it is forced by the crossbar 5' to the angular position shown in the figure at insertion of the key 5 in the keyway 4. Latching elements not represented and activated by means of key 5 prevent the indexing wheel 9 from being turned to the angular position represented in the illustration by, for example, a screwdriver or filament when the key is not in the keyway 4.

The stator 12 of an electromagnet is located concentric to the ram 6 in housing 2. The stator 12 surrounding the ram 6 is connected to the housing 2 by a platform or the like. As shown in the figure, the ram 6 has an intermediate section 6' whose diameter is larger in comparison to the diameter of the two end sections. The entire ram can, therefore, consist of a ferromagnetic material. The length of this intermediate section 6' is approximately equal to the axial length of the stator 12, and only a relatively small air gap exists between its inner wall and the outer surface of the intermediate section 6'. A pre-tensioned helical spring 13 which surrounds the end section of the ram 6 lying against the actuating rod 7, and which is supported on its end away from the switch 8 by a shoulder of the ram 6, is supported on the other side by a plate 14 solidly attached to the housing and thus presses the upper end of the ram 6 onto the outer surface of the indexing wheel 9. As shown in the figure, this wheel is provided with a resting notch 15 on the other side of the cam 10 which has the shortest distance from the axis of the indexing wheel 9. The ram 6 engages this notch due to the force of the helical spring 13 when the indexing wheel 9 in the line of sight according to the figure. This kind of torque exists if a force is exerted pulling the key out of the keyway 4.

If the ram 6 is engaged with the resting notch 15, its intermediate section 6' is pushed out of the stator 12 far enough so that when the intermediate section 6' is shifted back into the stator 12, the push-rod 6 is lifted from the resting notch. The shift is thus equal to the depth of the resting notch 15.

As long as the machine for which the safety switch is meant is in operation, the ram 6 is held by the helical spring 13 in engagement with the resting notch 15. The key 5 cannot be removed from the keyway 4 during this time, since a corresponding rotation of the indexing wheel is prevented by the ram 6. The indexing wheel 9, and as a result the key 5, also cannot be released by shutting off the machine. Only when the machine comes to a standstill is the stator 12 energized and the ram 6 removed from the keyway 4, thereby turning the indexing wheel 9. The ram 6 travels on the cam 10 on its high side whereby the ram 6 is pushed against the switch against the force of the helical spring 13 and the switching circuit in the control circuit of the machine its forced open.

While preferred forms and arrangements have been shown in illustrating the invention, it is to be understood that various changes and modifications may be made without departing from the spirit and scope of this disclosure.

I claim:

1. A safety switch comprising:

a housing having a keyway provided therein:

an axially sliding ram positioned in said housing and functioning as a switching actuator;

an indexing wheel with a cam having at least one locking flank;

a pre-tensioned spring extending between said housing and one end of said ram for holding the ram in place;

a key having a crossbar for contacting the at least one locking flank said wheel with which the indexing wheel can be turned by force either at insertion into the keyway or at removal, and;

an interlocking mechanism provided in said housing, said mechanism having a stator which is fastened inside a housing of the safety switch for producing a magnetic force, and with which the key can be secured for a delay time against removal from the keyway;

wherein a section of the ram surrounded by the stator is constructed as an armature of the stator of the electromagnet.

2. A safety switch according to claim 1, wherein the locking flank is formed from a flank of a resting notch of the indexing wheel.

3. A safety switch according to claim 2, wherein the locking flank and a region of a surface of the ram form a self locking mechanism.

4. A safety switch according to claim 1, wherein the locking flank and a region of a surface of the ram form a self locking mechanism.

5. A safety switch comprising:

a housing;

a ram shifting in a longitudinal direction of the ram as a switching actuator;

an indexing wheel with a cam having at least one locking flank and having a radial notch cut;

a pre-tensioned spring for holding one end of the ram in place, the pretensioned spring being attached on a first end to the ram and being attached on a second end to the housing;

a key having a crossbar which engages the radial notch cut of the indexing wheel so that the key turns the indexing wheel at insertion of the key in a keyway tangential to the indexing wheel; and an interlocking mechanism including an electromagnet mounted in the housing and having a stator;

wherein a section of the ram is constructed as an armature of the electromagnet;

wherein the stator of the electromagnet surrounds the armature; and wherein the ram engages the locking flank of the indexing wheel in a locking position thus securing the key for a delay time against removal from the keyway.

6. A safety switch according to claim 5, wherein the locking flank is formed from a flank of a resting notch of the indexing wheel.

7. A safety switch according to claim 5, wherein the locking flank and a region of a surface of the ram form a self locking mechanism.

8. A safety switch according to claim 5, wherein the locking flank and a region of a surface of the ram form a self locking mechanism.

* * * * *

UNITED STATES PATENT AND TRADEMARK OFFICE

CERTIFICATE OF CORRECTION

PATENT NO. : 5,760,353
DATED : June 2, 1998
INVENTOR(S) : Rapp

It is certified that error appears in the above-indentified patent and that said Letters Patent is hereby corrected as shown below:

Column 3, line 34, change "locking flank said" to --locking flank of said--.

Signed and Sealed this

Twelfth Day of October, 1999

*Attest:*

*Attesting Officer*

Q. TODD DICKINSON

*Acting Commissioner of Patents and Trademarks*